US006006769A

United States Patent [19]

Lin

[11] Patent Number: 6,006,769

[45] Date of Patent: Dec. 28, 1999

[54] UMBRELLA STRUCTURE

[75] Inventor: Yao-Chin Lin, Tainan, Taiwan

[73] Assignee: Asia Umbrella Industries Co., Ltd., Tainan, Taiwan

[21] Appl. No.: 09/181,190

[22] Filed: Oct. 28, 1998

[30] Foreign Application Priority Data

Sep. 8, 1998 [TW] Taiwan ..... 87214813

[51] Int. Cl.[6] ..... A45B 25/26

[52] U.S. Cl. ..... 135/33.7; 135/31; 135/94

[58] Field of Search ..... 135/15.1, 31, 33.7, 135/33.71, 33.2, 91, 93, 94, 98, 99, 100

[56] References Cited

U.S. PATENT DOCUMENTS

| | | | |
|---|---|---|---|
| 3,456,661 | 7/1969 | Farley | 135/33.7 |
| 3,794,054 | 2/1974 | Watts | 135/98 |
| 3,896,830 | 7/1975 | Sharick | 135/93 |
| 4,838,293 | 6/1989 | Novak | 135/100 |
| 4,865,063 | 9/1989 | Williams | 135/33.7 |
| 5,078,166 | 1/1992 | Lee | 135/33.7 |
| 5,368,055 | 11/1994 | Johnson et al. | 135/33.7 |

*Primary Examiner*—Carl D. Friedman
*Assistant Examiner*—Winnie Yip
*Attorney, Agent, or Firm*—William E. Pelton, Esq.

[57] ABSTRACT

The umbrella has a frame composed of a plurality of ribs, stretchers and a combined panel consisting of a main panel and a secondary panel, wherein, the area of the main panel is smaller than that of the fully expanded ribs of the frame, and the inner edge of the secondary panel matches the outer edge of the main panel. The main and secondary panels concentrically cover the frame, and a plurality of ropes are mounted between the inner edge of the secondary panel and the frame, which are used to increase spaces between the outer edge of the main panel and the inner edge of the secondary panel, and moreover, improve efficiency of air convection, save panel material and simplify manufacturing procedures.

3 Claims, 4 Drawing Sheets

UMBRELLA STRUCTURE

BACKGROUND OF THE INVENTION

1. Field of the Invention

The present invention relates to an umbrella structure, and more particularly, to the improved design of the panel of the umbrella. The special design of the double panel of the umbrella of the present invention can efficiently save panel materials and provide ventilation.

2. Description of the Related Arts

An umbrella is used to shield sunshine by means of a panel attached to a frame, wherein, the frame consists of a plurality of movable ribs pivotally connected to a shaft. The panel covers the frame and shields the sunshine when the umbrella is opened.

Although the umbrella can shield the sunshine, the panel of the conventional umbrella is made of single layer of light cloth. In blocking the sunlight, the umbrella has bad ventilation which may make a user feel stuffy. Therefore, there are two types of combined panel umbrella on the market which can improve ventilation. The structure shown in FIG. 4 is one type of umbrella on the market. Referring to FIG.4, a panel (3) comprises a main panel (30) and a secondary panel (31), wherein the main panel (30) has a plurality of openings (301) spaced between the ribs (41). The secondary panel (31) is smaller than the fully opened main panel (30) and concentrically covered on the main panel (30). When the main panel (30) and secondary panel (31) are covered and secured on the ribs (41) of the shaft (40), the openings (301) of the main panel (30) is covered by the secondary panel (31) on the outer side thereof. With the above combined structure, when the umbrella is opened, air can flow into the space between the outer edge (311) of the secondary panel (31) and the main panel (30) and then into the umbrella through openings (301) of the main panel (30), therefore, air ventilation is improved.

The other combined type umbrella on the market is shown in FIG. 5. Referring to FIG. 5, a panel (5) composes a main panel (50) and a secondary panel (51), wherein, the main panel (50) matches the fully opened ribs (61) and has a circular gauze (501) therein. The secondary panel (51) is smaller than the fully opened main panel (50). When assembled, the secondary panel (51) and the main panel (50) are concentrically covered on the ribs (61) of a shaft (60), and the gauze (501) is covered with the secondary panel (51) on the outer side thereof. When the umbrella is opened, air can flow into the space between the outer edge (511) of the secondary panel (51) and the main panel (50) and then into the umbrella through the gauze (501) of the main panel (50). Therefore, air ventilation is improved.

Although the two types of umbrellas have improved air ventilation, there are several drawbacks as described in the following:

1. Bad Air Ventilation Efficiency

The main and sub panels of the two said types of umbrellas are concentrically superposed and mounted on the frame of the umbrellas. When the umbrellas are opened, the main and sub panels are expanded fully and the outer edge of the secondary panel is nearly in contact with the surface of the main panel. Therefore, the space between the main and sub panels is so small that air can not flow into the umbrella freely, and air ventilation and convection is bad.

2. Wastes More Materials

In the combined structure of panels as described above, the full areas of the main and sub panels are large. This design wastes much material and adds to the cost of production.

3. Increases Manufacturing Difficulty

In the structure of panels described above, the full areas of main and sub panels are large, and there are a plurality of openings and gauze with many holes. The design increases manufacturing difficulty, moreover, cost of the production.

SUMMARY OF THE INVENTION

The main object of the present invention is to provide an improved umbrella structure which can improve air convection efficiency, save material and simplify the manufacturing procedure of the umbrella. The umbrella comprises a frame, a plurality of stretchers and a combined panel composed of a main panel and a secondary panel, wherein, the area of the fully expanded main panel is smaller than that of the ribs of the frame, and the secondary panel extends from the outer edge of the main panel to outer edge of the frame. The main and sub panels concentrically cover the frame, and a plurality of ropes are provided between the inner edge of the secondary panel and the frame, which are used to increase the space between the outer edge of the main panel and the secondary panel, and improve air convection efficiency, save panel material required and simplify the manufacturing procedure.

Other objects, advantages, and novel features of the invention will become more apparent from the following detailed description when taken in conjunction with the accompanying drawing.

DESCRIPTION OF THE PREFERRED EMBODIMENT

Figure 1:
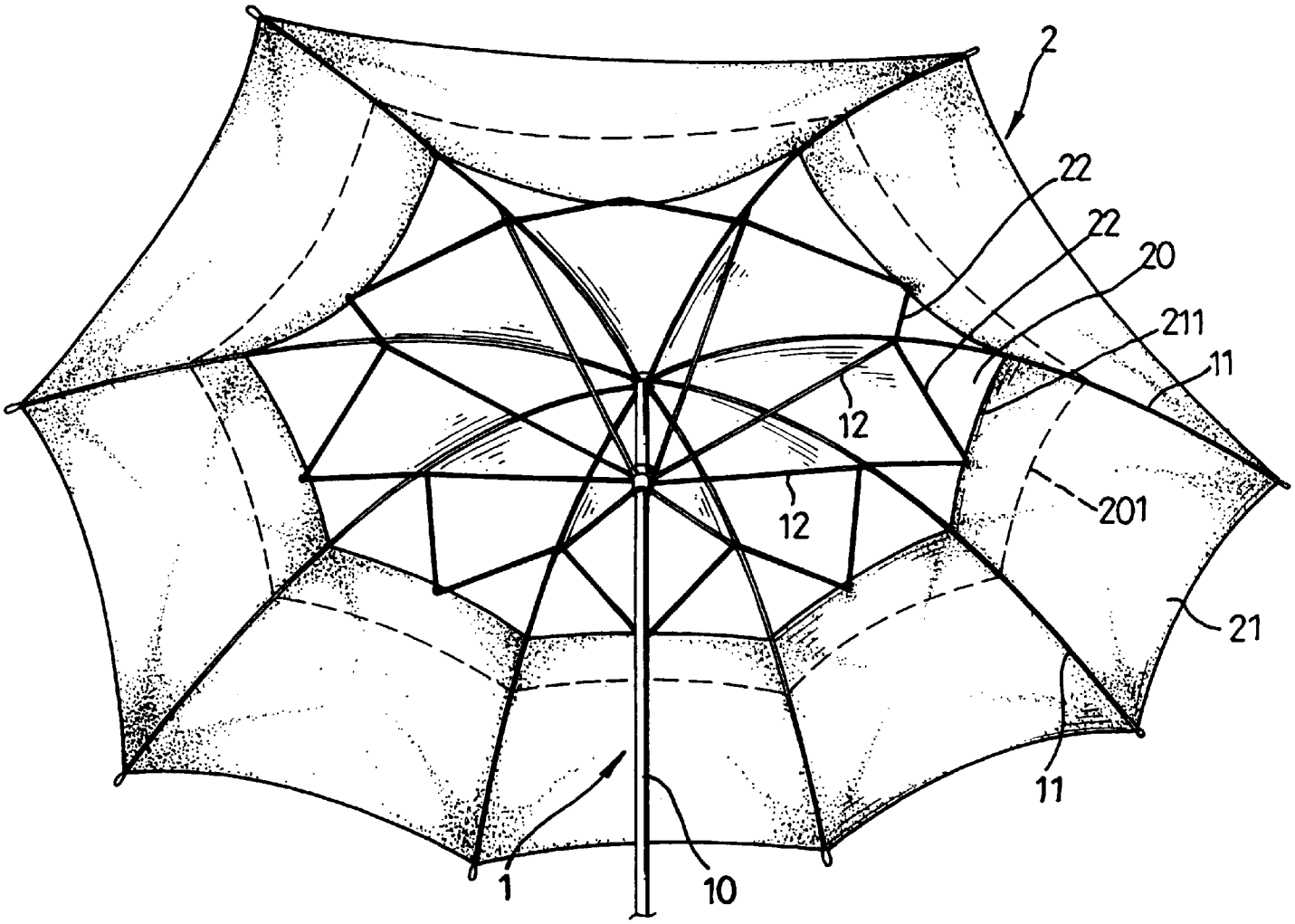
FIG. 1 is a bottom perspective view of the invention.

Referring to FIG. 1, an umbrella of the present invention comprises a frame (1) and a combined panel (2), wherein, the frame (1) is composed of a shaft (10) conjugated with an upper runner, a lower runner, a plurality of ribs (11), a plurality of stretchers (12) and other elements used in a conventional umbrella.

The panel (2) comprises a main panel (20) and a secondary panel (21), wherein, the area of the main panel (20) is smaller than that of the fully expanded ribs (11) and larger than that of the stretchers (12) pivotally connected with the ribs (11) and is nearly three fourths to four fifths of the area of the fully opened combined panel (2). The radial length of the circle shaped secondary panel (21) is longer than the length between the outer edge of the combined panel (2) and the outer edge (201) of the main panel (20). A plurality of flexible ropes (22) each are mounted between a corresponding stretcher (12) and the inner edge (211) of the secondary panel (21).

Figure 2:
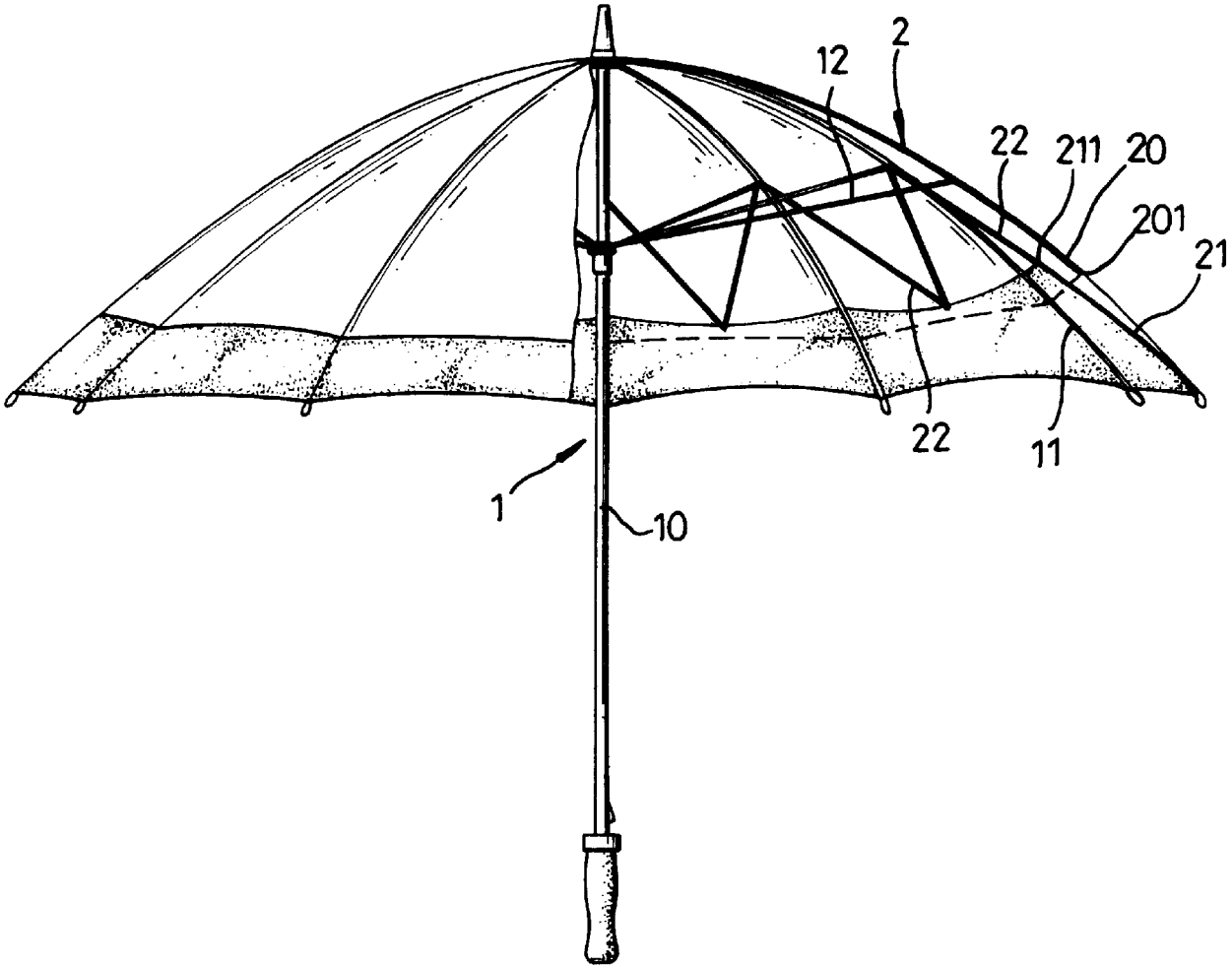
FIG. 2 is a side plan schematic view in partial section of the invention.

Referring to FIGS. 1 and 2, when assembled, the main panel (20) and the secondary panel (21) concentrically cover the frame (1) composed of ribs (11), and the outer edge of the main panel (20) is covered by the inner edge of the secondary panel (21). The ropes (22) secured on the inner edge of the secondary panel (21) are respectively mounted on the stretchers (12).

Figure 3:
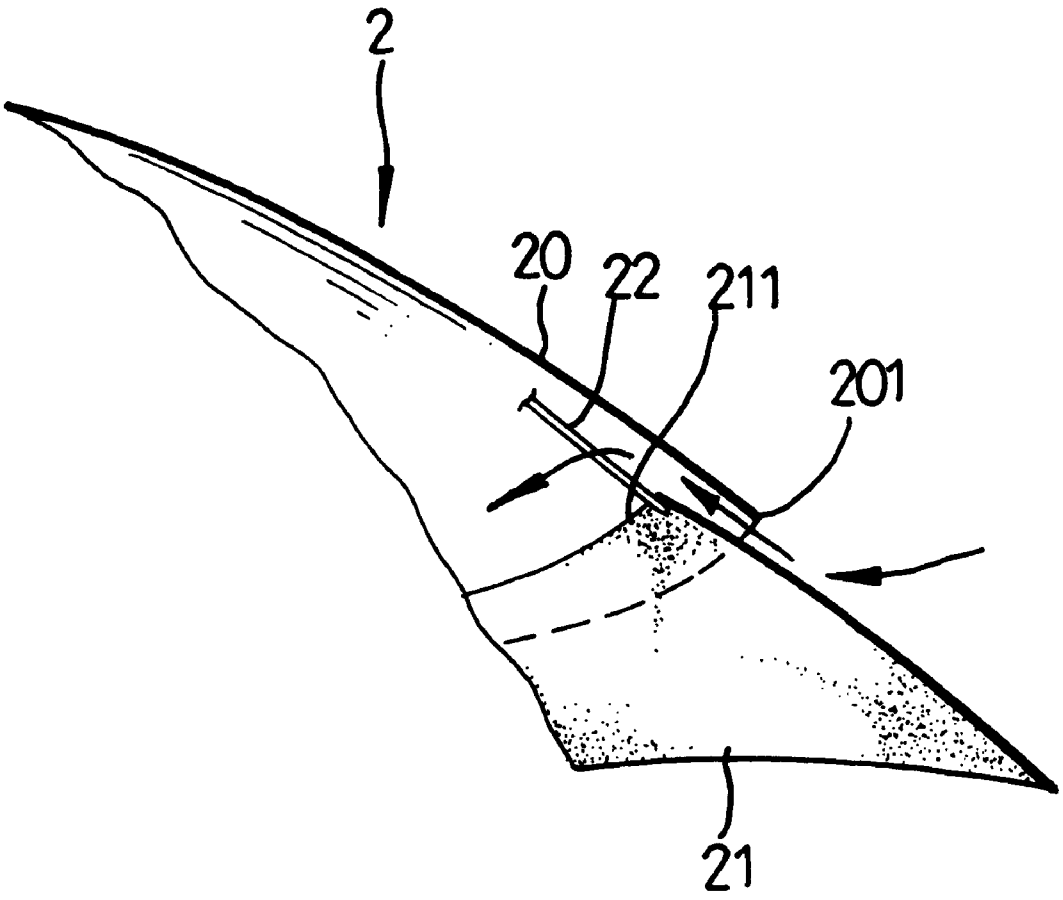
FIG. 3 is a partial schematic view in partial section of the panel of the invention.
Figure 4:
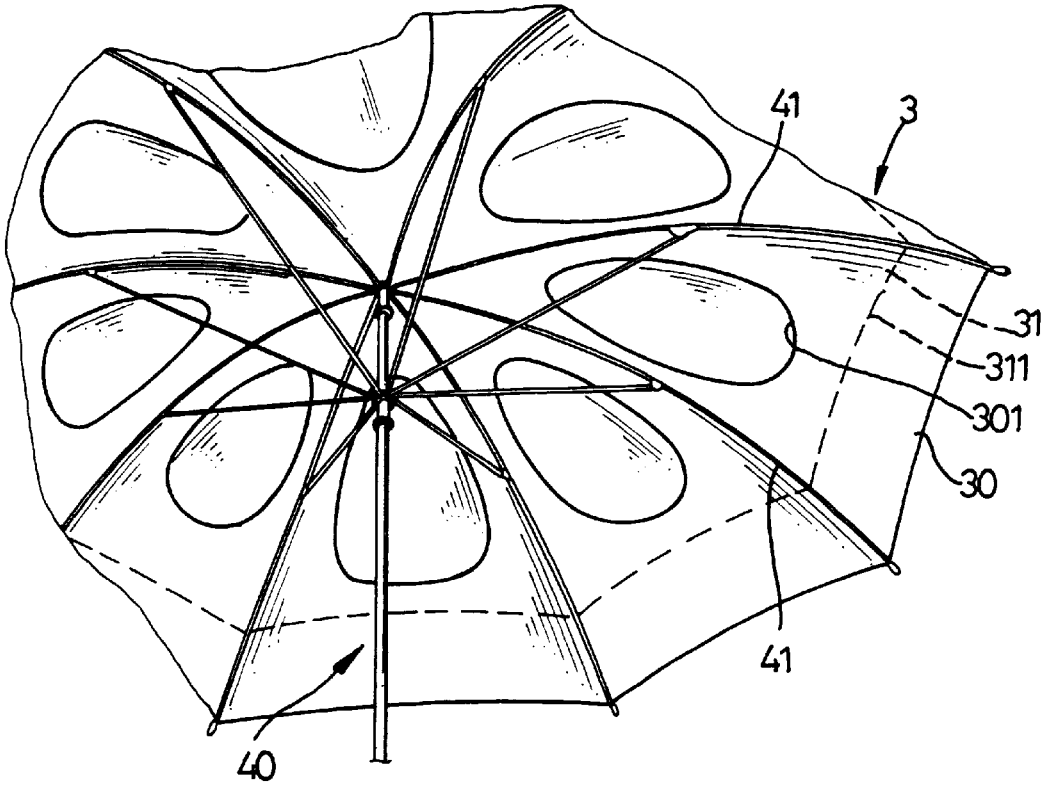
FIG.4 PRIOR ART
FIG. 4 is a bottom perspective view of a conventional umbrella.
Figure 5:
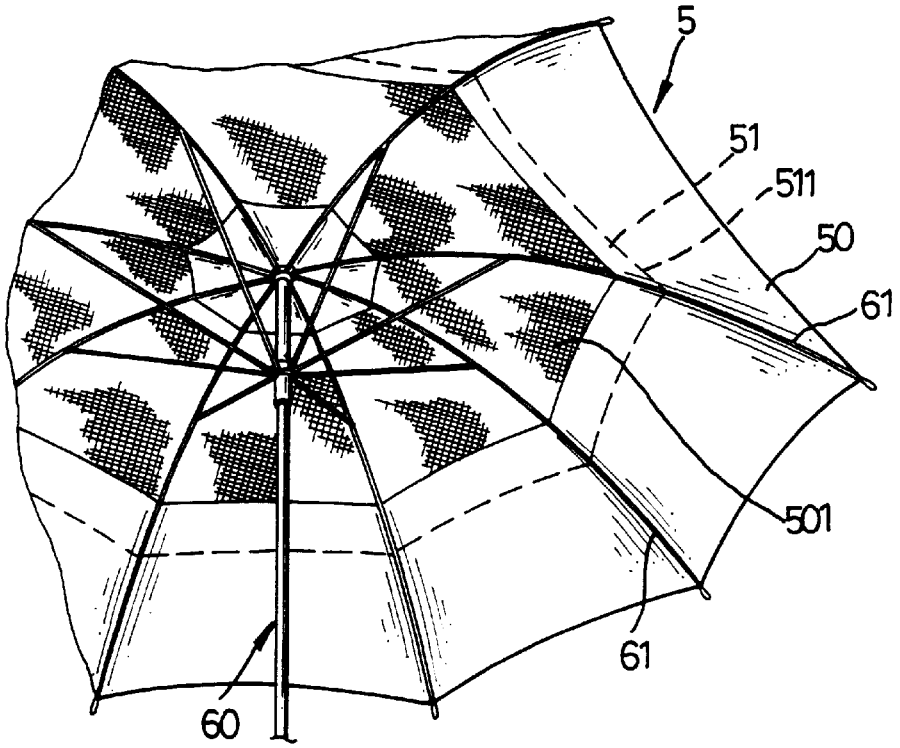
FIG.5 PRIOR ART
FIG. 5 is a bottom perspective view of another conventional umbrella.

When the umbrella of the invention is used, the main panel (20) and the secondary panel (21) are expanded simultaneously by the ribs (11), and a preferred large ventilating space is formed between the inner edge (211) of the secondary panel (21) and the outer edge (201) of the main panel (20) as the ropes (22) are drawn to lower the inner edge (211) of the secondary panel (21). As shown in FIG. 3, air can easily pass into the umbrella through the ventilating space and advance air convection efficiency. Therefore, when a user uses the umbrella under the sun, the user does not feel stuffy any longer.

From the description above, it is apparent that the present invention has several advantages such as good air convection efficiency, saving material and simple manufacturing procedure.

What is claimed is:

1. An umbrella comprising a frame and a combined panel, wherein, the frame has a shaft, a plurality of ribs and stretchers; and the combined panel is composed of a main panel and a secondary panel which are covered on the frame and connected to the ribs in concentric relation with respect to the shaft, wherein the improvement comprises:

an inner edge of the secondary panel matches the outer edge of the main panel, and the radial length of the secondary panel is longer than the length of the main panel; and a plurality of ropes each connected to the frame between the inner edge of the secondary panel and a pair of the stretchers adjacent said inner edge that is secured between two ribs.

2. The umbrella as claimed in claim 1, wherein, the area of the main panel is smaller than the area of the fully expanded frame.

3. The umbrella as claimed in claim 1, wherein, the ropes are made of flexible material.

* * * * *